United States Patent [19]

Reuter

[11] Patent Number: 4,995,595

[45] Date of Patent: Feb. 26, 1991

[54] SMELTING CRUCIBLE

[75] Inventor: Wolfgang Reuter, Niddatal, Fed. Rep. of Germany

[73] Assignee: Leybold Aktiengesellschaft, Hanau, Fed. Rep. of Germany

[21] Appl. No.: 881,707

[22] Filed: Jul. 3, 1986

[30] Foreign Application Priority Data

Mar. 22, 1986 [DE] Fed. Rep. of Germany ..... 3609836

[51] Int. Cl.[5] ..... C21B 3/00

[52] U.S. Cl. ..... 266/275; 432/265

[58] Field of Search ..... 266/275, 242, 286; 432/262, 263, 264, 265; 373/45, 156, 163

[56] References Cited

U.S. PATENT DOCUMENTS

| | | | |
|---|---|---|---|
| 1,774,816 | 9/1930 | Schultz | 432/263 |
| 3,162,710 | 12/1964 | Anderson | 266/275 |
| 3,223,519 | 12/1965 | Schippereit | 373/163 |
| 3,227,431 | 1/1966 | Steeves | 432/264 |
| 4,060,692 | 11/1977 | Naastepad et al. | 373/156 |
| 4,138,096 | 2/1979 | Boucher et al. | 266/242 |
| 4,583,230 | 4/1986 | Komada et al. | 373/156 |

*Primary Examiner*—S. Kastler

*Attorney, Agent, or Firm*—Felfe & Lynch

[57] ABSTRACT

Smelting crucible of mineral materials for melting down materials by electrical heating. In the base (2) of the crucible, there is a tapping opening (3) and, in the region of the upper edge of the crucible, there is a flange (4) for mounting the crucible in a holding device. To accomplish the objective of making the crucible suitable for use with larger charge weights, the crucible is surrounded inventively by a reinforcing device (10, 11), which can be stressed in tension and which connects the flange (4) with the base (2) of the crucible.

4 Claims, 1 Drawing Sheet

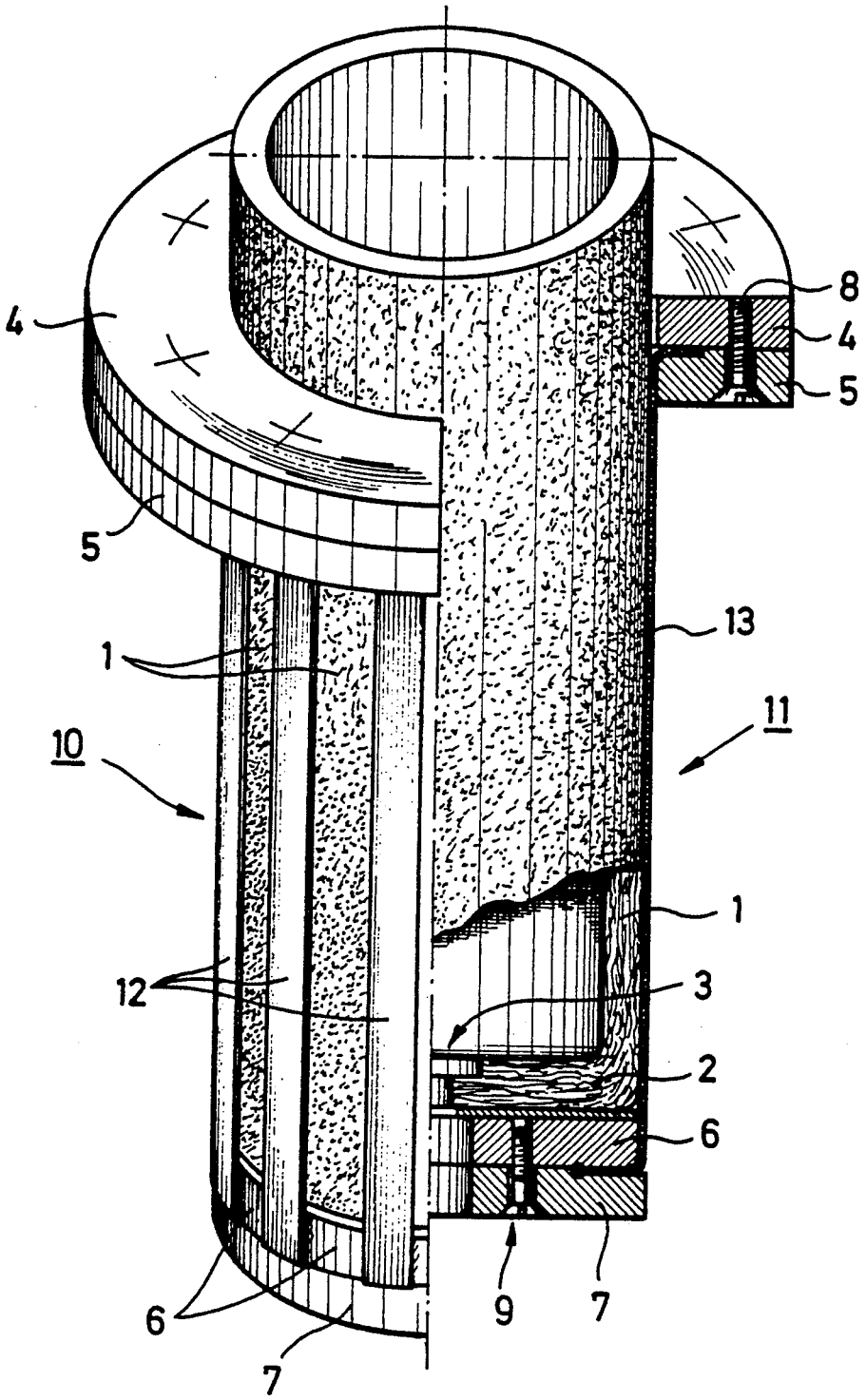
4
8
4
5
5
13
1
11
10
1
12
3
2
6
6
9
7
7

SMELTING CRUCIBLE

The invention relates to a smelting crucible, composed of mineral materials, for smelting down materials by electrical heating, with a tapping opening in the base of the crucible and, at the upper edge of the crucible, a flange for mounting the crucible in a holding device.

BACKGROUND OF THE INVENTION

Such crucible are known; for the manufacture of precision castings, the so-called "fine castings", they are charged with a block of the material for the casting, which is fused by electrical heating (a) resistance heating or an inductive heating). The tapping opening in the base is closed off by a small plate, the so-called "penny", until the contents of the crucible have been fused completely.

The crucible, which usually is rather thin-walled and comprises an impregnated, fibrous mineral material, is subjected in such operations to very severe stresses and is therefore suitable only for use with relatively limited charge weights of not more than about 5 kg.

It is therefore an object of the invention to improve a smelting crucible of the initially described type, so that it is also suitable for accommodating larger charge weights.

SUMMARY OF THE INVENTION

This objective is accomplished inventively for a smelting crucible of the type initially described, owing to the fact that the crucible is surrounded by a reinforcing device, which can be stressed in tension and connects the flange with the base of the crucible.

The reinforcing device may, moreover, comprise a series of parallel and perpendicular metal strips; it may, however, also be formed by an outer enclosure of a fibrous, mineral material, for example, by a sort of sack of amorphous silicon dioxide.

By means of the inventive measure, it becomes possible to increase the charge weight to amounts clearly larger than 5 kg, as a result of which the range of applications of such crucibles is clearly expanded.

BRIEF DESCRIPTION OF THE DRAWING

Referring now to the drawing, the drawing comprises a single FIGURE, which shows, in the left half, a perspective representation of a crucible with a reinforcing device of metal strips and, in the right half, a partial axial section through a crucible with a reinforcing device comprising a fibrous, mineral material.

BRIEF DESCRIPTION OF THE PREFERRED EMBODIMENTS

The FIGURE shows a smelting crucible with a cylindrical crucible casing 1 with a crucible base 2, in which a central tapping opening 3 is disposed. Crucible casing

1 and base 2 are made from a fibrous, mineral material, which is sold, for example, under the name of "Procal 12N5" by the Steibe company.

In the area of its upper edge, the smelting crucible is surrounded by a flange 4, which is made, for example, from asbestos cement or an asbestos-free hard insulating board. Below the flange 4, there is a counter-ring 5 and, below the base 2 of the crucible, there is a supporting ring 6 with a counter ring 7. The counter rings 5 and 7 are connected by means of screws 8 and 9 respectively with the flange 4 and the supporting ring 6 respectively. The crucible is surrounded by a reinforcing device 10 or 11, which can be stressed in tension and which connects the flange 4 with the base 2 of the crucible. As shown in the Figure on the left, the reinforcing device 10 comprises a series of parallel metal strips 12, which are connected with the supporting ring 6. For this purpose, the metal strips 12 are angular radially inwards at their lower ends and clamped between the supporting ring 6 and the counter ring 7.

As is evident from the right half of the Figure, the reinforcing device 11 comprises an outer enclosure 13 of a fibrous mineral material, which can be stressed in tension, such as, for example a "sack" of amorphous silicon dioxide. Such a material is sold, for example, under the name of "Siltemp" by the Hellhacke company. This enclosure 13 is closed over the whole periphery of the casing 1 of the crucible and contacts this two-dimensionally.

The metal strips 12 as well as the enclosure 13 form a sort of supporting basket, which largely relieves the mechanical stresses on the casing 1 of the crucible.

I claim:

1. A smelting crucible for smelting down a block of material by electrical heating for making precision castings, comprising:

a thin-walled casing of fibrous, mineral material for making precision castings, and including a base of fibrous, mineral material with a tapping opening therein, the tapping opening being closed during smelting by a metal plate;

a flange at an upper edge of the crucible for mounting the crucible in a holding device; and reinforcing means which can be stressed in tension and which connects the flange to the base of the crucible, the reinforcing means being so constructed as to allow gas to escape from the casing through the fibrous, mineral material thereof.

2. A smelting crucible according to claim 1, wherein the reinforcing means comprises spaced metal strips.

3. A smelting crucible according to claim 1, wherein the reinforcing means comprises an outer enclosure of a fibrous, mineral material.

4. A smelting crucible according to claim 1, wherein the crucible has a cylindrical crucible casing which is surrounded by the reinforcing means.

* * * * *

UNITED STATES PATENT AND TRADEMARK OFFICE

CERTIFICATE OF CORRECTION

PATENT NO. : 4,995,595

DATED : February 26, 1991

INVENTOR(S) : Wolfgang Reuter

It is certified that error appears in the above-identified patent and that said Letters Patent is hereby corrected as shown below:

Column 1, line 14 for "(a)" read -- (a --.

Column 2, lines 47-48 for "allow gas ... the casing" read -- form a supporting basket which relieves the mechanical stress on the casing --.

Signed and Sealed this

Second Day of August, 1994

*Attest:*

Bruce Lehman

BRUCE LEHMAN

*Attesting Officer*

*Commissioner of Patents and Trademarks*